US011230452B1

(12) United States Patent
Razai

(10) Patent No.: US 11,230,452 B1
(45) Date of Patent: Jan. 25, 2022

(54) SMART TOILET PAPER DISPENSER

(71) Applicant: Smart TP, San Jose, CA (US)

(72) Inventor: Masiullah Razai, San Jose, CA (US)

(73) Assignee: SMART TP, San Jose, CA (US)

( * ) Notice: Subject to any disclaimer, the term of this patent is extended or adjusted under 35 U.S.C. 154(b) by 0 days.

(21) Appl. No.: 17/332,964

(22) Filed: May 27, 2021

(51) Int. Cl.

| | |
|---|---|
| ***B65H 16/00*** | (2006.01) |
| ***A47K 10/36*** | (2006.01) |
| ***B65H 16/10*** | (2006.01) |
| *A47K 10/32* | (2006.01) |

(52) U.S. Cl.
CPC ..... *B65H 16/005* (2013.01); *A47K 10/36* (2013.01); *B65H 16/106* (2013.01); *A47K 2010/3233* (2013.01); *A47K 2010/3693* (2013.01); *B65H 2551/14* (2013.01); *B65H 2553/40* (2013.01)

(58) Field of Classification Search
CPC ..... B65H 16/005; B65H 16/106; B65H 2551/14; B65H 2553/40; A47K 10/36; A47K 2010/3233; A47K 2010/3693
See application file for complete search history.

(56) References Cited

U.S. PATENT DOCUMENTS 6,685,075 B1 * 2/2004 Kannankeril ..... A47F 9/042 225/106
6,702,147 B2 * 3/2004 Ashford ..... A47K 10/421 221/34
8,960,494 B1 * 2/2015 Gluck ..... A47K 10/421 221/102
9,161,621 B1 * 10/2015 Huffin ..... A47K 10/185
9,220,380 B2 * 12/2015 Gluck ..... B65D 83/0805
9,826,867 B2 * 11/2017 Krause ..... B65D 55/02
2003/0071100 A1 * 4/2003 Miller ..... A47K 10/3836 225/38
2010/0163569 A1 * 7/2010 Parker ..... A47K 10/3818 221/1
2015/0297043 A1 * 10/2015 Osborne, Jr ..... A47K 10/3612 242/563.2
2016/0150921 A1 * 6/2016 Shea ..... A47K 10/40 242/598.3
2016/0353947 A1 * 12/2016 Osborne, Jr. ..... B65H 16/106
2020/0187728 A1 * 6/2020 Osborne, Jr. ..... B65H 16/10
2020/0205621 A1 * 7/2020 Osborne, Jr. .... G06K 19/07758

* cited by examiner

*Primary Examiner* — Michael E Gallion
(74) *Attorney, Agent, or Firm* — Adibi IP Group, PC; Amir V. Adibi; Andrew G. Palmer

(57) ABSTRACT

A smart toilet paper dispenser comprises a powered paper dispenser, an enclosure, a plurality of drawers, and a top surface. The smart toilet paper dispenser receives user input and in response dispenses a predetermined amount of paper. The user input is motion detected by a motion sensor, a voice command detected by a microphone, or touch detected by a push button. A switch allows a user to select one of multiple paper lengths dispensed by the smart toilet paper dispenser. The top surface comprises a non-slip surface and includes a plurality of ridges and a raised perimeter to prevent items placed thereupon from rolling. The top surface includes a groove large enough to accommodate a user's device. Storage drawers are included, one of which holds trash bags. A novel smart toilet paper dispenser allows easier, touchless operation of the device and removes one touchpoint by which pathogens are transmitted.

19 Claims, 14 Drawing Sheets

SMART TOILET PAPER DISPENSER

TECHNICAL FIELD

The present invention relates generally to sanitary devices, and more specifically, to toilet paper dispensers.

BACKGROUND INFORMATION

Commercial, residential, healthcare and industrial spaces typically have restroom spaces for human occupants. Sanitation is a primary concern within these spaces. These spaces may contain various devices to offer supplies allowing users to maintain an acceptable level of sanitation.

SUMMARY

A smart toilet paper dispenser comprises a powered paper dispenser, an enclosure, a plurality of drawers, and a top surface. The smart toilet paper dispenser receives user input and in response dispenses a predetermined amount of paper. The user input is motion detected by a motion sensor, a voice command detected by a microphone, or touch detected by a push button. A switch allows a user to select at least one of a plurality of different paper lengths the smart toilet paper dispenser will dispense. The top surface comprises a non-slip surface and includes a plurality of ridges and a raised perimeter to prevent items placed thereupon from rolling. The top surface includes a groove large enough to accommodate a user's device. In one embodiment, a storage drawer is provided. In another embodiment, a storage drawer and a trash receptacle drawer are provided. A novel smart toilet paper dispenser allows easier, touchless operation of the device and removes one touchpoint by which pathogens are transmitted.

The novel smart toilet paper dispenser comprises a powered paper dispenser that is partially or entirely covered by an enclosure. The enclosure includes a top section which comprises a plurality of drawers and a top surface. One drawer is configured to dispense small trash bags. Another drawer is configured to hold medical supplies, sanitary supplies, feminine hygiene products, or other supplies that may be necessary in a restroom. The top surface covers at least the entire area of the top of the smart toilet dispenser. In one embodiment, the top surface is formed from a non-slip surface. The top surface includes a plurality of ridges and a raised perimeter to prevent items placed upon it, such as medical supplies or a user's personal effects, from moving around or rolling over the edge onto the ground. The top surface also includes a groove deep and wide enough to accommodate a user's device such as a smartphone, tablet, or other device.

The novel smart toilet paper dispenser dispenses paper in response to user input. User input is received in one of three ways: motion, touch, or voice command. The user input is detected by a motion sensor, a microphone, or a push button. The detection device then transmits a signal to a microcontroller which controls a motor to rotate. The motor turns a feed roller which causes paper to dispense out through the bottom of the dispenser. In one embodiment, the novel smart toilet paper dispenser dispenses one of two predetermined amounts of paper. In another embodiment, more than two lengths of paper are selectable. In another embodiment, the length of paper dispensed is not selectable. In yet another embodiment, the length of paper dispensed is fixed.

In one embodiment, the novel smart toilet paper dispenser also includes a night light disposed on the bottom of the smart toilet paper dispenser. The light is connected to a switch with three positions, "On," "Off," and "Motion." In the "On" position, the night light will remain on, illuminating the space below the smart toilet paper dispenser. In the "Off" position, the light will not illuminate. When the switch is in the "Motion" position, the light will illuminate in response to a user input. In another embodiment, the night light is disposed in a location other than the bottom of the smart toilet paper dispenser.

The smart toilet paper dispenser includes an LED strip light disposed on the front face of the dispensing mechanism that displays the status of the smart toilet paper dispenser. For example, when the smart toilet paper dispenser is dispensing paper, the LED strip light will flash blue, and when the smart toilet paper dispenser is empty, the LED strip light will flash red.

A smart toilet dispenser allows a user to acquire toilet paper without physical interaction with the smart toilet dispenser. A user that is physically unable to push a button located on the smart toilet paper dispenser, or unable to wave their hand or other appendage to trigger a motion sensor, can still cause the smart toilet paper dispenser to dispense paper by speaking a voice command. The smart toilet paper dispenser allows touchless operation of the device, removing one of the touchpoints by which pathogens and other contaminants may be transmitted. A smart toilet paper dispenser allows users unable to physically trigger the dispensing mechanism to trigger the dispensing mechanism by other means.

Further details and embodiments and methods are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

In the description and claims, terms such as "clockwise (CW)", "counterclockwise (CCW)", "top", "bottom", "front", "back", and "side" are used to describe relative directions and orientations between different parts of the novel smart toilet paper dispenser, and it is to be understood that the overall structure being described can actually be oriented in any way in three-dimensional space. For example, when a first object is described as rotating counterclockwise, it is to be understood that the first object may in fact be rotating clockwise when viewed from a different perspective.

Figure 1:
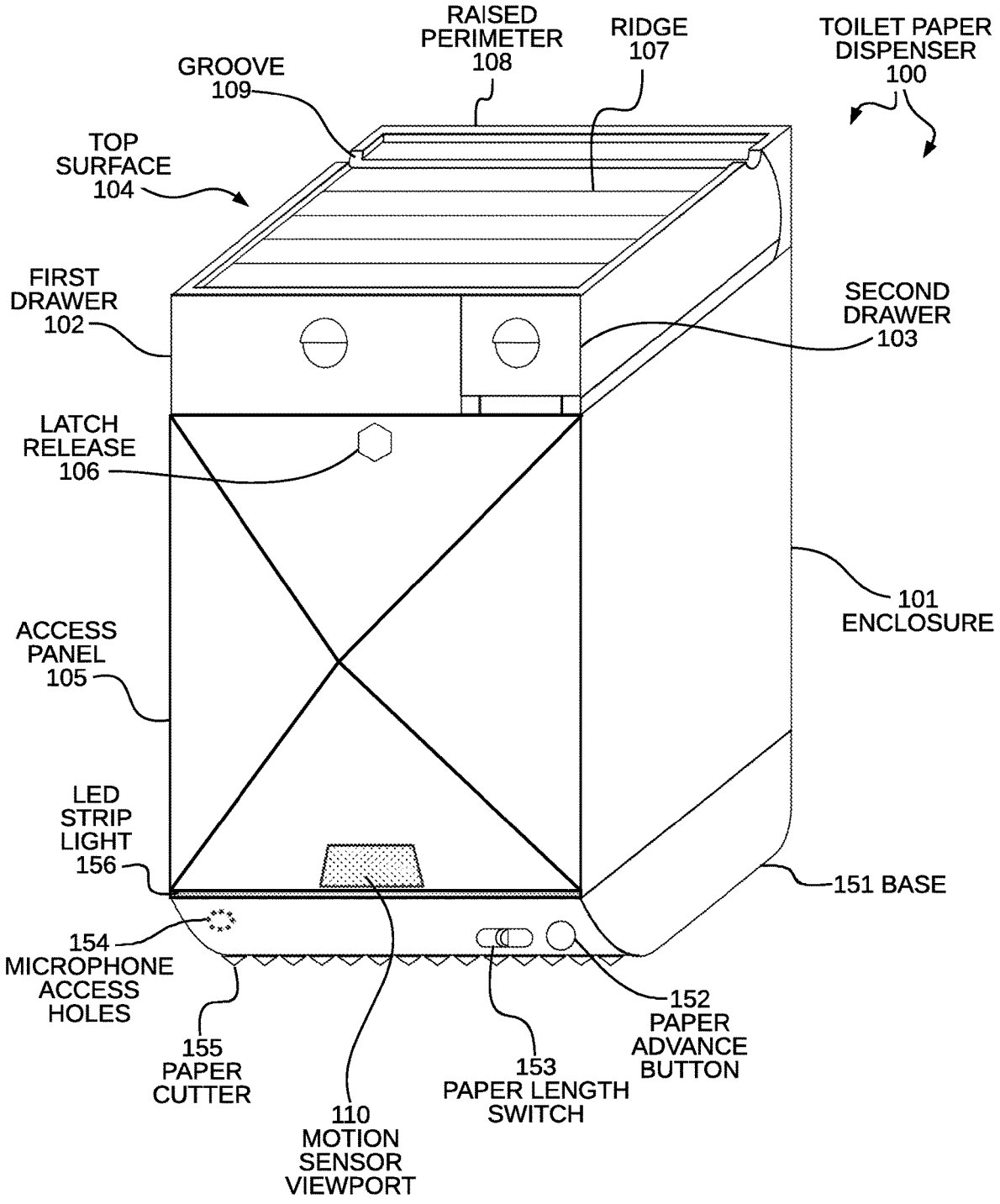
FIG. 1 is a diagram of a toilet paper dispenser 100.

FIG. 1 is a diagram of a toilet paper dispenser 100. The toilet paper dispenser 100 comprises an enclosure 101 and a paper dispenser 150 (see FIG. 4). The enclosure 101 at least partially encloses the paper dispenser 150. The enclosure 101 comprises a first drawer 102, a second drawer 103, a top surface 104, and an access panel 105. The top surface 104 comprises a plurality of ridges, a raised perimeter 108, and a groove 109. Reference numeral 107 identifies one of the ridges. The access panel 105 includes a latch release 106 and a motion sensor viewport 110. The paper dispenser 150 comprises a base 151, a paper advance button 152, a paper length switch 153, a microphone 174, a plurality of microphone access holes 154, a paper cutter 155, and an LED strip light 156. The microphone access holes 154 cover the microphone 174.

The toilet paper dispenser 100 is activated by user input generated by one of the following: activating a first motion sensor 159, pushing the paper advance button 152, or issuing a voice command which is then received by the microphone 174. One of two lengths of paper is then dispensed by the toilet paper dispenser 100, either a long length or a short length. The length of paper dispensed is selected by the position of paper length switch 153. In one embodiment, after paper is dispensed a user cuts the dispensed paper using the paper cutter 155. In another embodiment, the paper dispensed by paper dispenser 150 is perforated. In yet another embodiment, paper cutter 155 is not present.

The LED strip light 156 displays various colors and patterns to inform a user or maintenance technician about the status of the toilet paper dispenser 100. In one embodiment, the LED strip light 156 toggles between outputting a variety of colors in a flashing mode or solid mode depending on status. For example, when the access panel 105 is in the open position, the LED strip light 156 is solid red. When the toilet paper dispenser 100 is dispensing paper, the LED strip light 156 is flashing blue. When the paper roll 157 is empty, the LED strip light 156 is flashing red. When the toilet paper dispenser 100 is ready to accept a user input (also called standby mode), the LED strip light 156 is solid blue. When the smart toilet paper dispenser is powered off, the LED strip light 156 is off.

Figure 2:
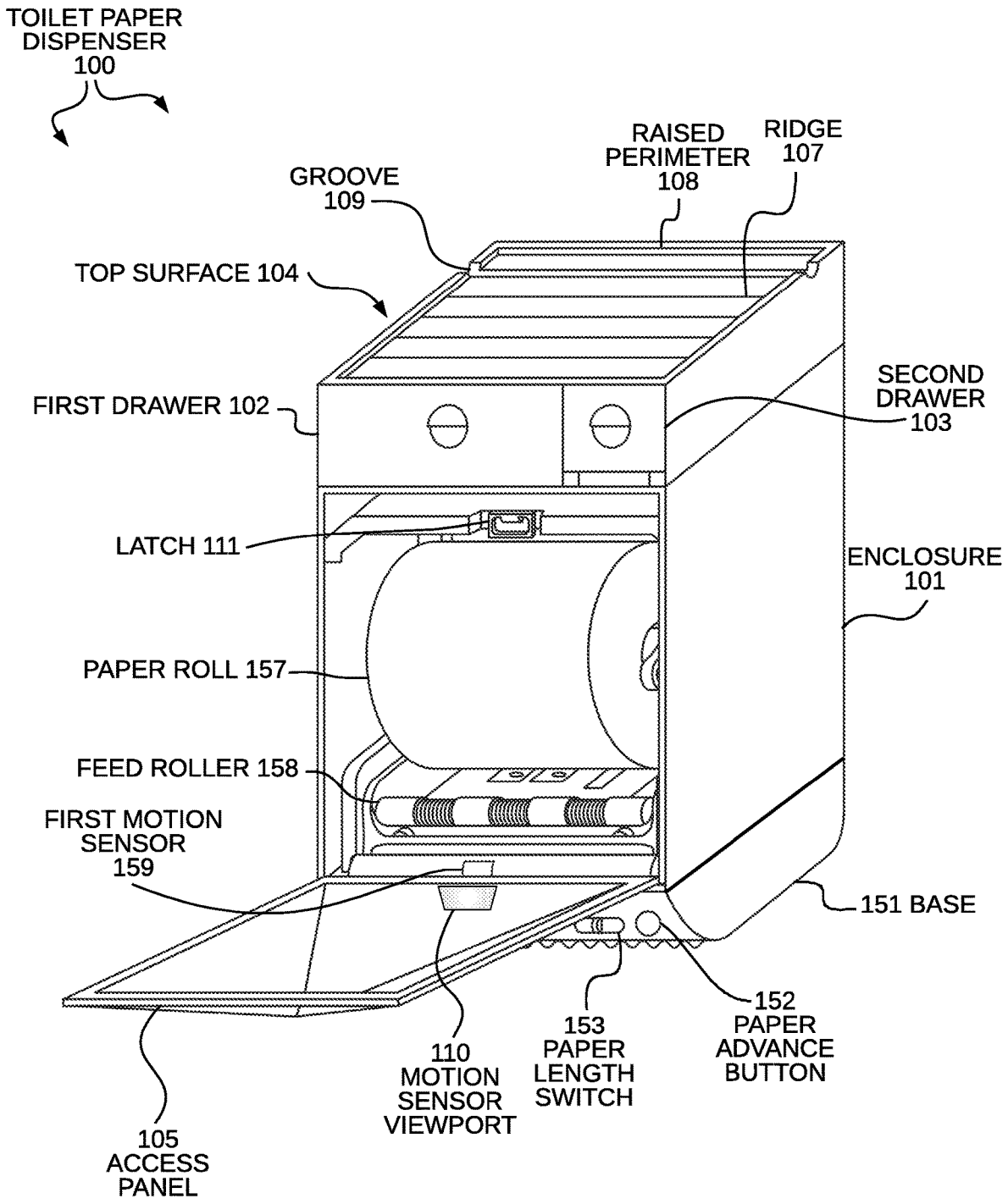
FIG. 2 is a diagram of the toilet paper dispenser 100 with an access panel 105 in an open position.

In one embodiment, The access panel 105 is connected to the base 151 and connected to the paper dispenser 150 with an operable latch 111 (see FIG. 2). The latch 111 is disposed behind the access panel 105, specifically behind the latch release 106. The access panel 105 includes motion sensor viewport 110 that is transparent to the radiation required for the first motion sensor 159 to operate. In another embodiment, the access panel 105 is connected to the enclosure 101.

FIG. 2 is a diagram of toilet paper dispenser 100 with access panel 105 in the open position. The paper roll 157, feed roller 158 and first motion sensor 159 are disposed within the enclosure 101. Latch 111 secures the access panel 105 in the closed position when engaged.

The access panel 105 allows access to the interior of the enclosure 101. In this embodiment, the access panel 105 is manufactured to be large enough to permit the paper roll 157 to be changed when the access panel 105 is in the open position.

The first motion sensor 159 is disposed on the base 151 of the paper dispenser 150. The first motion sensor 159 is disposed in front of the feed roller 158 and behind access panel 105. When the first motion sensor 159 detects a user's motion, the first motion sensor 159 generates and transmits a signal to the paper dispenser circuit 170 to dispense paper (see FIG. 9).

Figure 3:
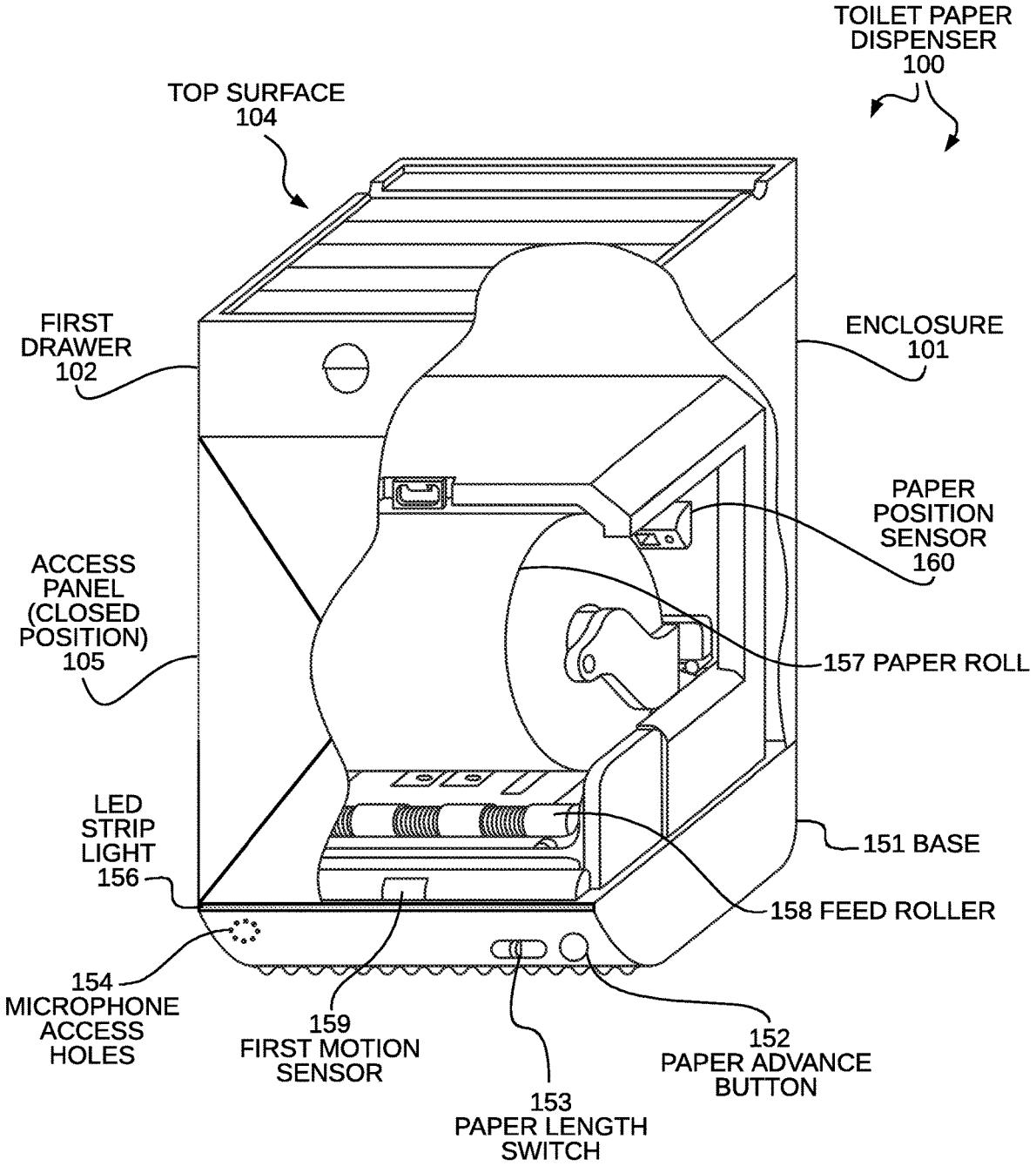
FIG. 3 is a cutaway diagram of the toilet paper 100 dispenser with the access panel 105 in a closed position.

FIG. 3 is a cutaway diagram of toilet paper dispenser 100 with access panel 105 in the closed position. A paper position sensor 160 is disposed within the enclosure 101. The paper position sensor 160 detects the amount of paper left on the paper roll 157. In this example, when there is no paper present on paper roll 157, LED strip light 156 will flash red.

Figure 4:
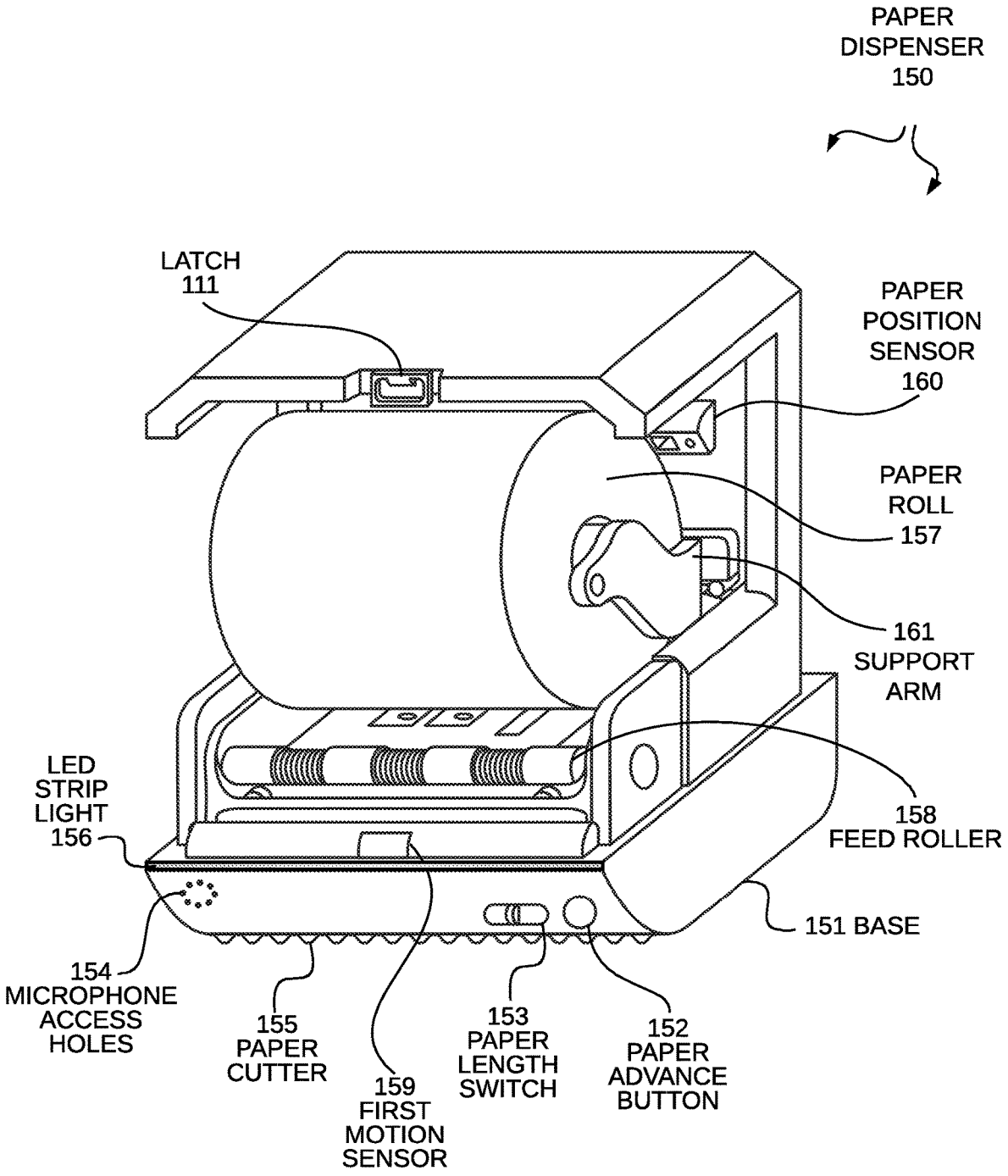
FIG. 4 is a diagram of a paper dispenser 150.

FIG. 4 is a diagram of the paper dispenser 150. Paper dispenser 150 comprises the base 151, the paper advance button 152, the paper length switch 153, the microphone access holes 154, the paper cutter 155, the LED strip light 156, the paper roll 157, the feed roller 158, the first motion sensor 159, the paper position sensor 160, and a support arm 161. The base 151 supports the other components, including the access panel 105, and mates with the enclosure 101.

The paper dispenser 150 contains the components to detect a user input and to dispense paper in response to that user input. When the toilet paper dispenser 100 detects a user input, the feed roller 158 rotates. In one embodiment, the paper roll 157 is connected to support arm 161 directly in a manner that allows paper roll 157 to spin freely. In another embodiment, a support rod connected to support arm 161 extends through the center of paper roll 157 allowing paper roll 157 to spin freely around the support rod. In yet another embodiment, a second support arm may connect directly to the opposite side of the paper roll 157 and allow paper roll 157 to spin freely. The roll of paper disposed on paper roll 157 has one connected end attached to the roll's tubular base. The paper is wound around the tubular base. A free end of paper extends from the circumference of the roll. The free end of the paper disposed on paper roll 157 is in contact with feed roller 158. When the feed roller 158 rotates, paper is drawn from the paper roll 157, over feed roller 158, and out through opening 162 (see FIG. 8). When paper passes through opening 162, LED strip light 156 flashes blue. The paper position sensor 160 detects the amount of paper remaining on paper roll 157. When the paper position sensor detects that there is no paper remaining on paper roll 157, LED strip light 156 flashes red.

The first motion sensor 159 detects a user's motion and generates a motion detect signal. A paper dispenser circuit 170 is coupled to receive the motion detect signal, and in response, controls the feed roller 158 to rotate and dispense paper. As the feed roller 158 rotates, paper roll 157 is unrolled and paper exits through opening 162 (see FIG. 8). Alternatively, the user may push the paper advance button 152, which generates a paper advance button signal. A paper dispenser circuit 170 is coupled to receive the paper advance button signal, and in response, controls the feed roller 158 to rotate and dispense paper. Alternatively, the user may speak a voice command. The voice command is detected by microphone 174. The microphone 174 generates a voice command signal. A paper dispenser circuit 170 is coupled to receive the voice command signal, and in response, controls the feed roller 158 to rotate and dispense paper.

Figure 5:
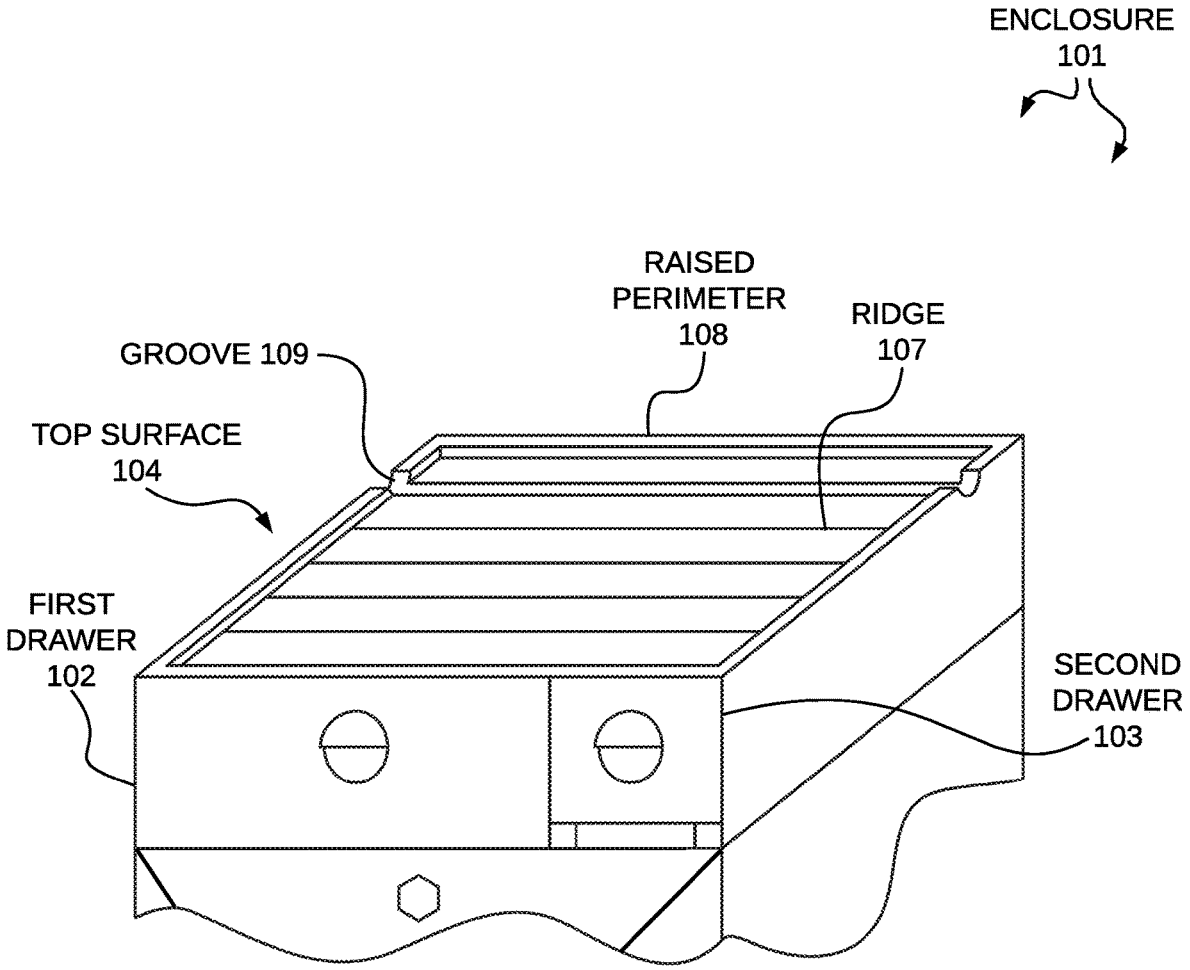
FIG. 5 is a diagram of a top section of an enclosure 101.

FIG. 5 is a diagram of the top section of the enclosure 101. The top section of the enclosure 101 comprises a first drawer 102, a second drawer 103, a top surface 104, a plurality of ridges, a raised perimeter 108, and a groove 109. Reference numeral 107 identifies one of the ridges.

The top surface 104 is a non-slip surface. It includes a plurality of ridges, one of which is indicated by reference numeral 107, that provide further resistance to unwanted movement of items placed upon it. The raised perimeter 108 prevents items from rolling and falling over the edge. A user may place a variety of items on top surface 104, such as keys or medical items. The groove 109 is made deep and wide enough to accommodate a user device, such as a smartphone or tablet in an upright position.

Figure 6:
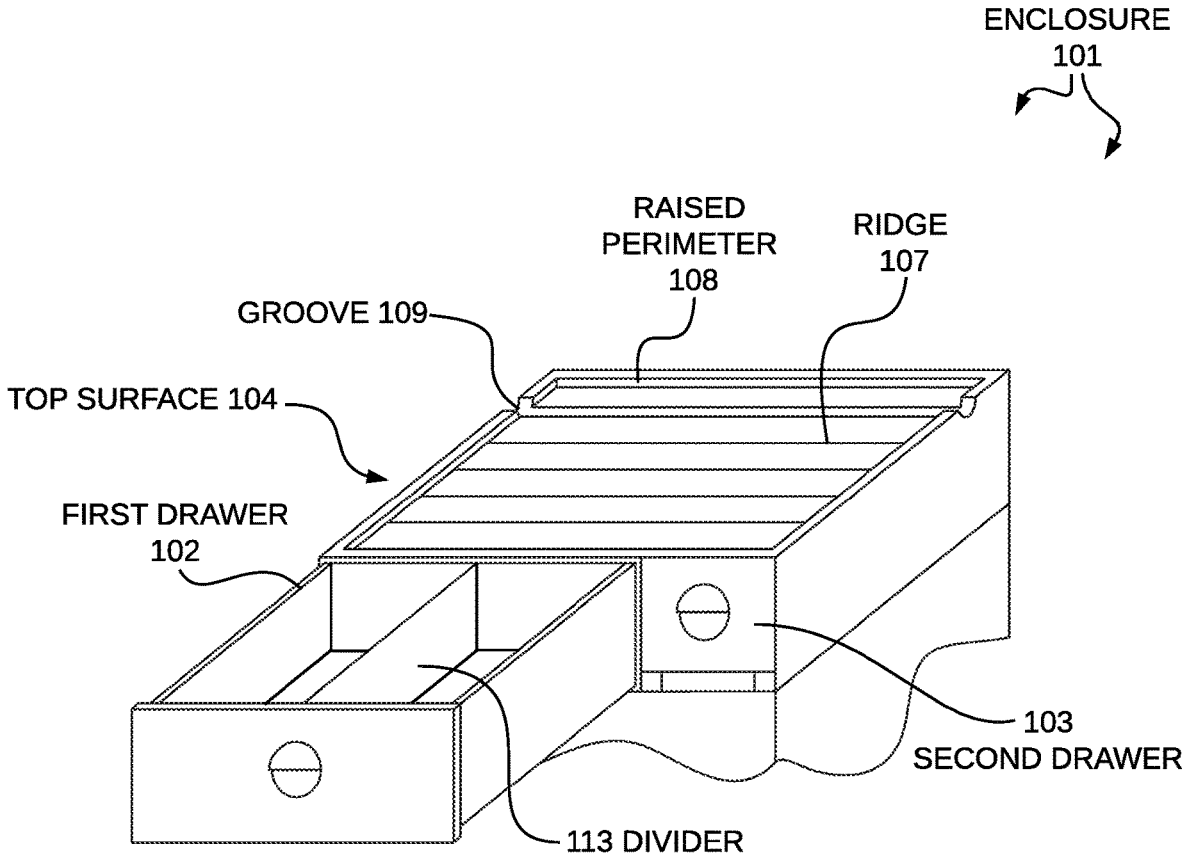
FIG. 6 is a diagram of the top section of the enclosure 101 with a first drawer 102 in an open position.

FIG. 6 is a diagram of the top section of the enclosure 101 with the first drawer 102 in an open position. In the embodiment shown in FIG. 6, the first drawer 102 includes a divider 113. In another embodiment, first drawer 102 does not include divider 113.

Figure 7:
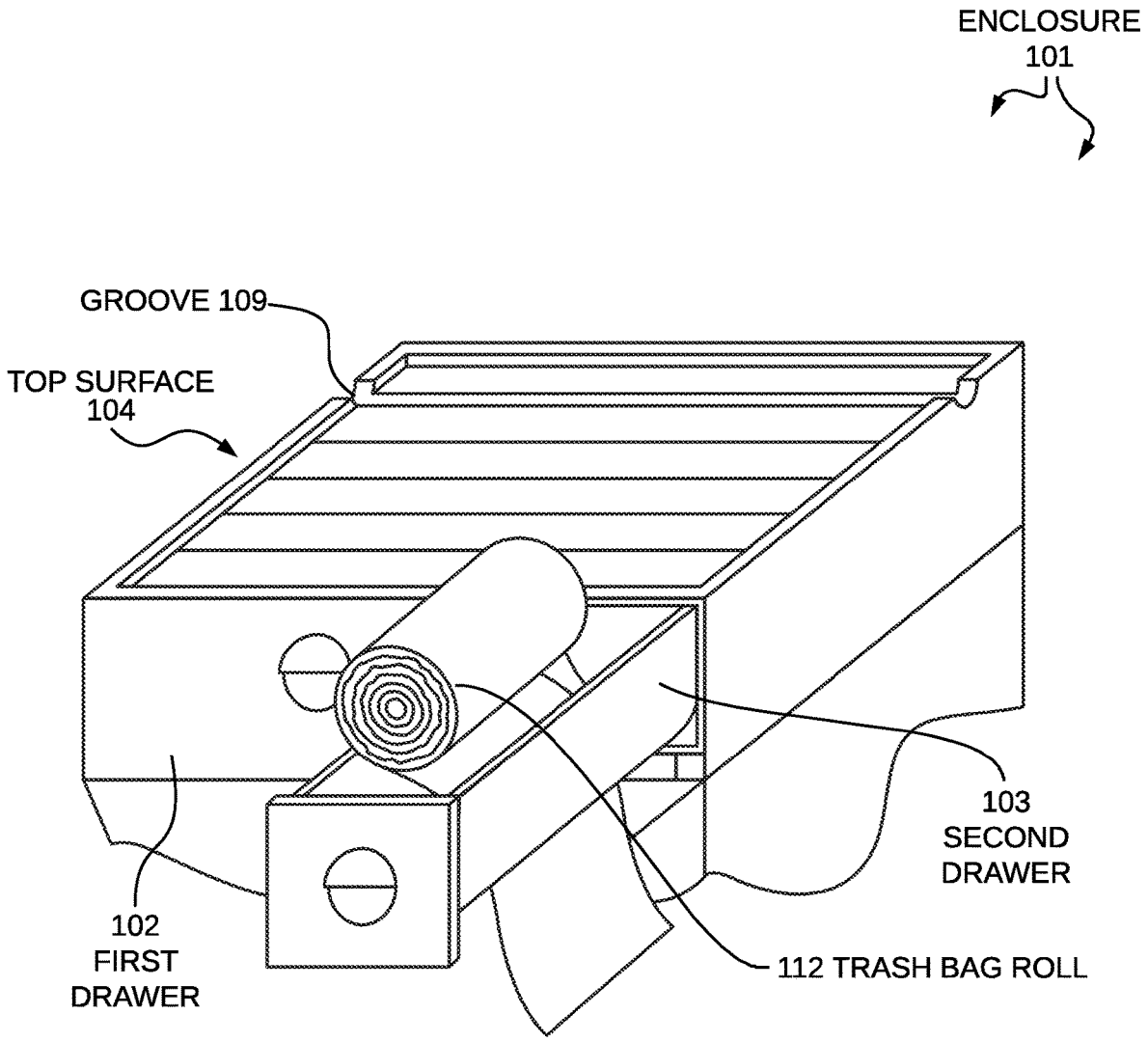
FIG. 7 is a diagram of the top section of the enclosure 101 with a second drawer 103 in an open position.

FIG. 7 is a diagram of the top section of the enclosure 101 with the second drawer 103 in an open position. In the embodiment shown in FIG. 7, the second drawer 103 is a trash bag dispenser and holds a trash bag roll 112. In another embodiment, the second drawer 103 is a drawer.

Figure 8:
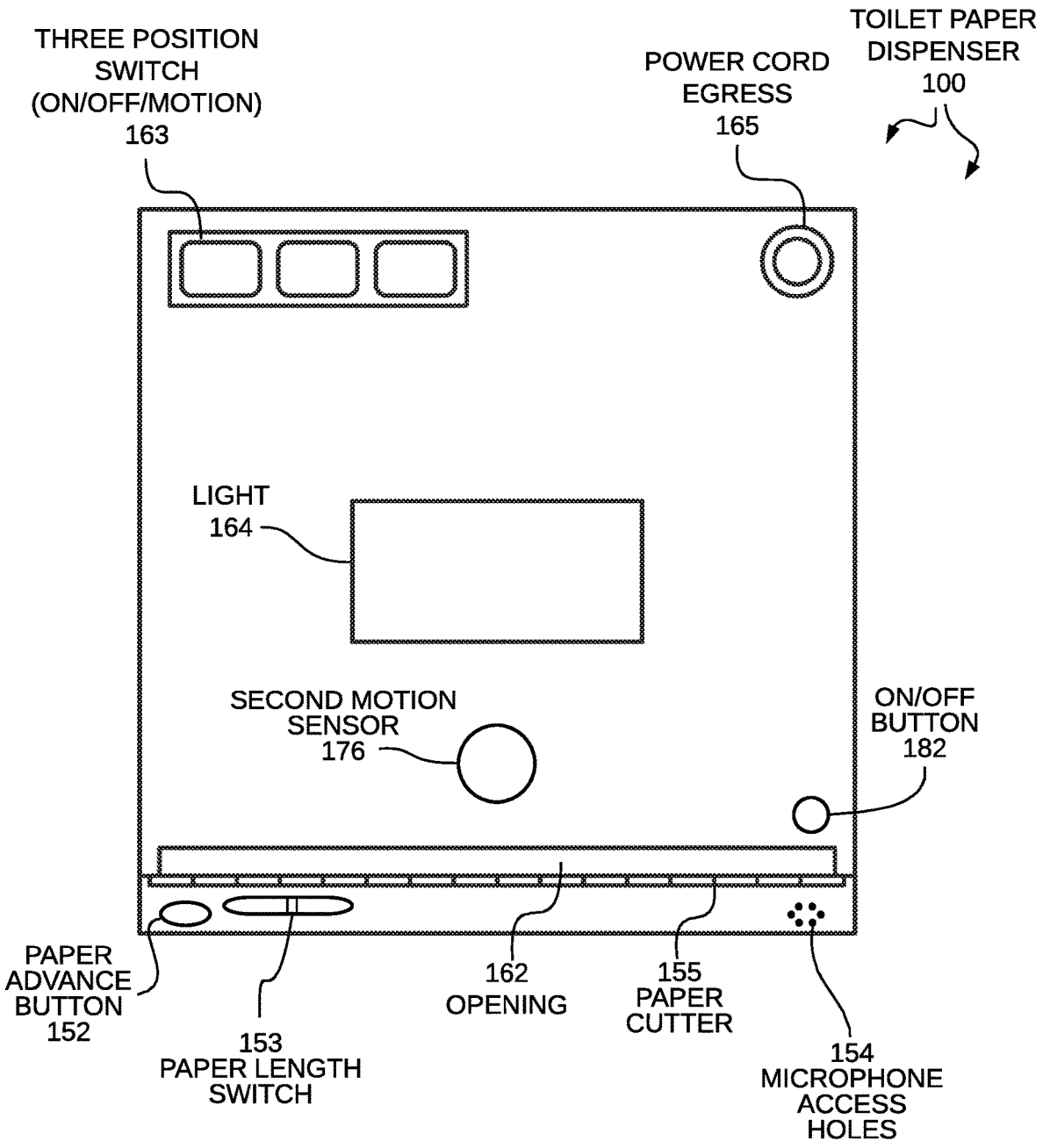
FIG. 8 is a diagram of a bottom view of a base 151 of the paper dispenser 150.

FIG. 8 is a diagram of a bottom view of the base 151 of the paper dispenser 150. Disposed on the bottom face of base 151 are paper cutter 155, an opening 162, a three position switch 163, a light 164, a second motion sensor 176, a power cord egress 165, and an On/Off button 182.

The opening 162 is of sufficient width to permit toilet paper to pass through it. The opening 162 provides a passage for toilet paper from paper roll 157 within the enclosure 101 and out through the base 151. The three position switch 163 has three selectable positions: "Off," "On," and "Motion." When the three position switch 163 is in the "On" position, the light 164 will remain illuminated. When the three position switch 163 is in the "Off" position, the light 164 will not illuminate. When the three position switch 163 is in the "Motion" position, the light 164 will illuminate when a user activates the second motion sensor 176. When On/Off button 182 is pressed, On/Off button 182 generates and sends a signal to microcontroller 171 (see FIG. 9) to power on toilet paper dispenser 100 if toilet paper dispenser is powered off, or to power off toilet paper dispenser 100 if toilet paper dispenser 100 is powered on.

Figure 9:
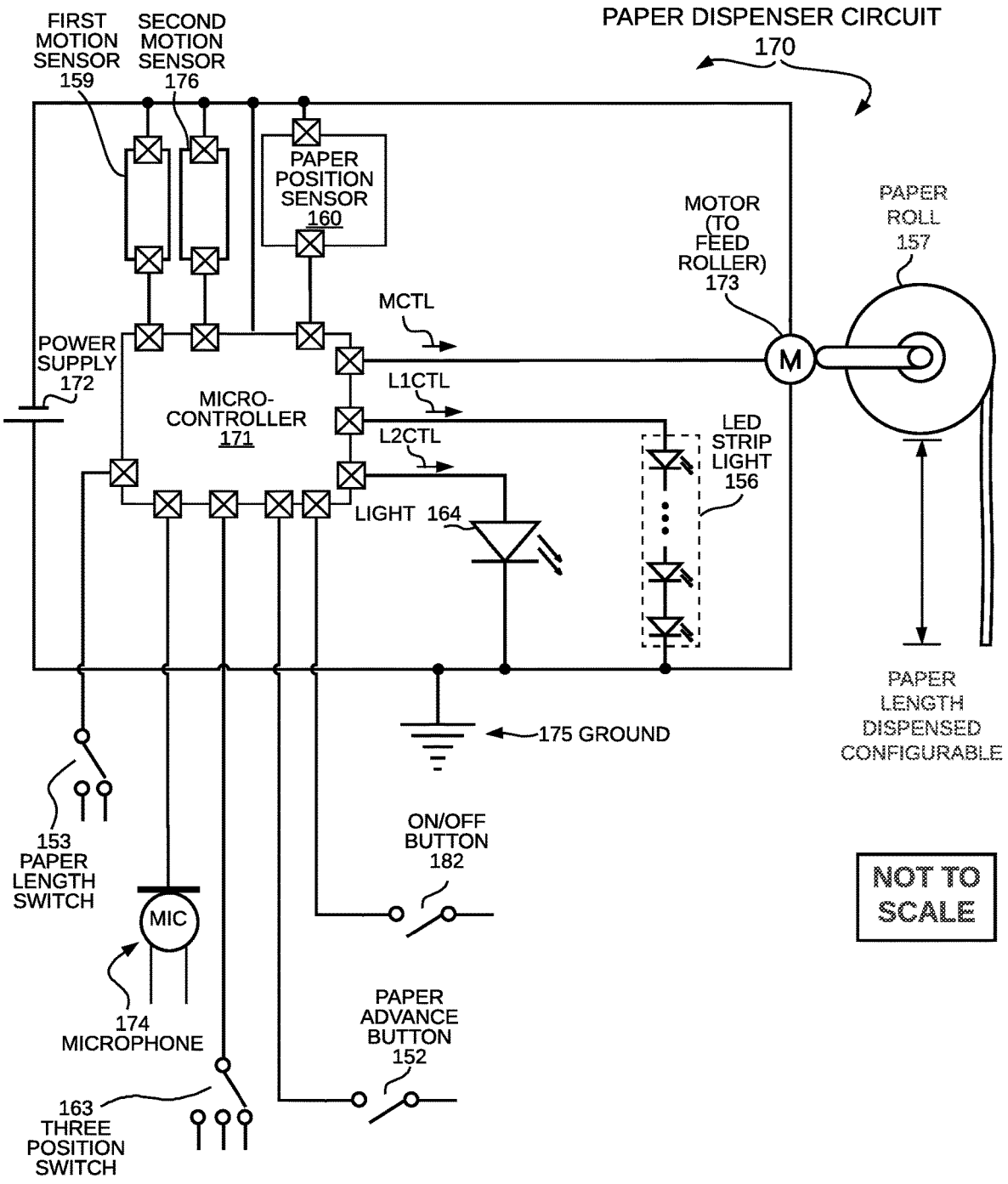
FIG. 9 is a circuit diagram of a paper dispenser circuit 170.

FIG. 9 is a circuit diagram of a paper dispenser circuit 170. The paper dispenser circuit 170 comprises a microcontroller 171, a power supply 172, a motor 173, a microphone 174, a ground 175, the paper advance button 152, the paper length switch 153, the LED strip light 156, the first motion sensor 159, the second motion sensor 176, the paper position sensor 160, the three position switch 163, light 164, and On/Off button 182.

When a toilet paper dispenser 100 is installed and powered on, and paper roll 157 is full of paper, the toilet paper dispenser 100 is ready for operation. Microcontroller 171 will receive a signal from paper position sensor 160 indicating the paper roll 157 is sufficiently full and does not need to be changed. The microcontroller 171 will send a signal to LED strip light 156 to display a solid blue color, indicating standby mode to a user. Components receive power from power supply 172. In one embodiment, power supply 172 is a non-rechargeable, replaceable battery. In another embodiment, power supply 172 is a rechargeable battery. In another embodiment, power supply 172 is a connection to an external power source such as mains power or low voltage power.

To activate the toilet paper dispenser 100, a user will provide one of three inputs. When the first motion sensor 159 detects a user's motion, first motion sensor 159 generates and communicates a motion detect signal to microcontroller 171. In response, the microcontroller 171 controls the motor 173 to rotate and microcontroller 171 controls the LED strip light 156 to flash blue. When the user pushes the paper advance button 152, the paper advance button 152 generates and communicates a signal to microcontroller 171. In response, the microcontroller 171 controls the motor 173 to rotate and microcontroller 171 controls the LED strip light 156 to flash blue. Alternatively, the user may speak a voice command that is detected by microphone 174. The microphone 174 generates and communicates an audio signal to microcontroller 171. In response, the microcontroller 171 controls the motor 173 to rotate and microcontroller 171 controls LED strip light 156 to flash blue. When microcontroller 171 controls the motor 173 to rotate, the signal is either a signal to rotate for more revolutions or fewer revolutions, resulting in a longer or shorter length of paper dispensed. The length of paper dispensed is determined by a paper length setting 166. The microcontroller 171 determines the paper length setting 166 based on the position of the paper length switch 153.

When a user provides a user input, a signal is received by microcontroller 171. In response, microcontroller 171 controls the motor 173 to rotate. In one embodiment, motor 173 is directly attached to feed roller 158. In another embodiment, motor 173 is attached to feed roller 158 by a gear, a series of gears, a chain and sprocket assembly, a belt and pulley assembly, or other transmission means. The rotation of motor 173 causes the feed roller 158 to rotate. When the feed roller 158 rotates, paper is dispensed through the opening 162. In one embodiment, an incremental encoder is coupled to feed roller 158. The incremental encoder sends a signal to microcontroller 171 indicating how many revolutions feed roller 158 has completed. In response to the signal from the incremental encoder and using the paper length switch signal information, microcontroller 171 controls the motor 173 to stop rotating when the desired paper length has been dispensed.

When the three position switch is in the "On" position, the three position switch generates and communicates an "On" signal to microcontroller 171. In response, microcontroller 171 controls light 164 to illuminate and/or remain illuminated. When the three position switch is in the "Off" position the three position switch generates and communicates an "Off" signal to microcontroller 171. In response, microcontroller 171 controls light 164 to not illuminate. When the three position switch is in the "Motion" position, the three position switch generates and sends a "Motion" signal to microcontroller 171. When a user input is provided, it is detected by the second motion sensor 176. In response, the second motion sensor 176 generates and communicates a signal to microcontroller 171. In response, microcontroller 171 controls light 164 to illuminate. On/Off button 182 generates and sends a signal to microcontroller 171 to power on toilet paper dispenser 100 if toilet paper dispenser is powered off, or to power off toilet paper dispenser 100 if toilet paper dispenser 100 is powered on.

Figure 10:
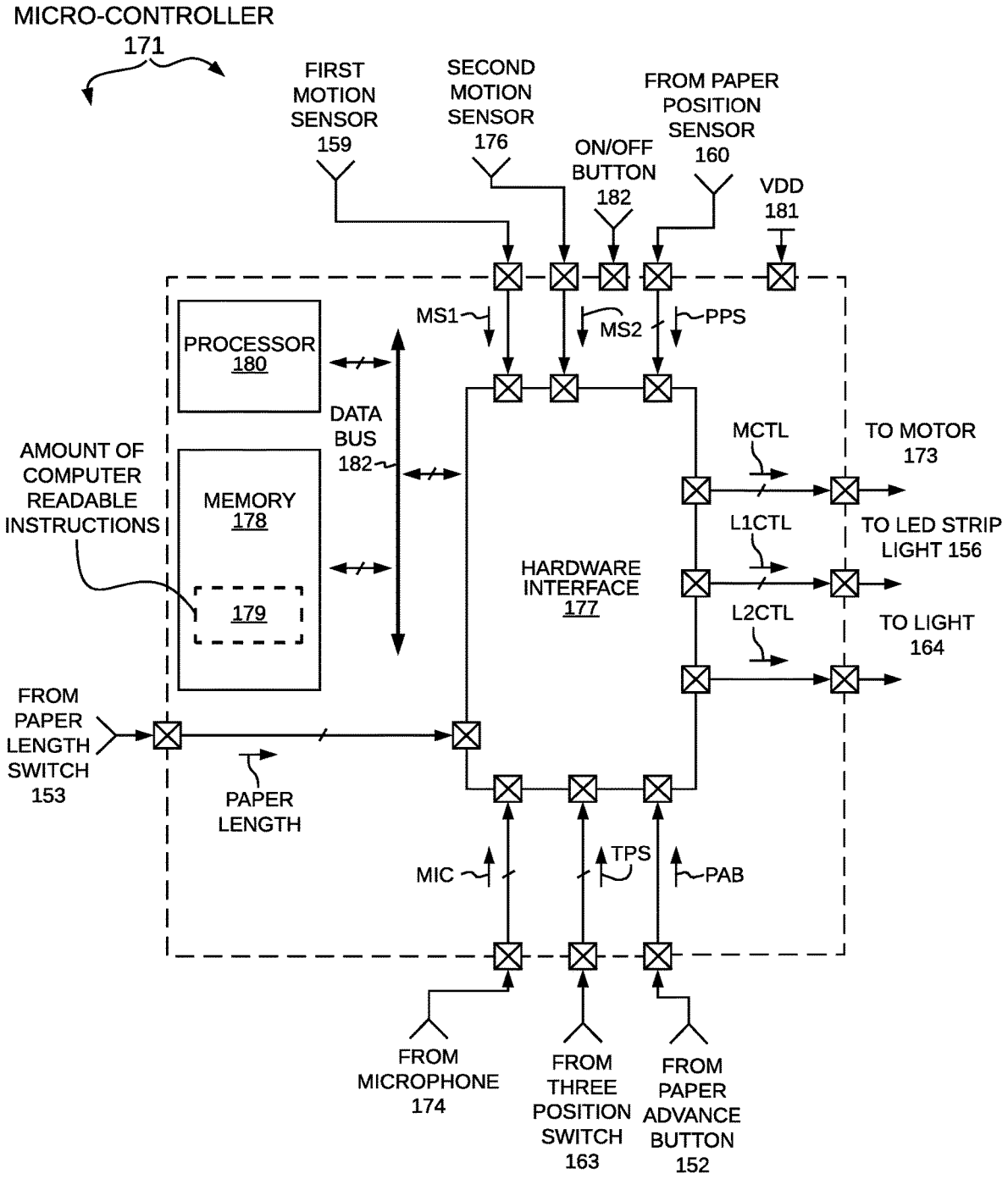
FIG. 10 is a more detailed diagram of a microcontroller 171.

FIG. 10 is a circuit diagram of a microcontroller 171. A hardware interface 177 is connected to input components that include a first motion sensor 159, a second motion sensor 176, a paper position sensor 160, a paper advance button 152, a three position switch (TPS) 163, a microphone 174, and a paper length switch 153. Hardware interface 177 is also connected to output components that include a motor 173, an led strip light 156, and a light 164. A processor 180, memory 178 and an amount of computer readable instructions 179 are included within the microcontroller 171. Processor 180 and memory 178 are connected to hardware interface 177 via data bus 182. Processor 180 is any suitable processor capable of interpreting or executing instructions. Hardware interface 177 is any suitable hardware or input/output interface capable of interfacing with input or output devices, such as cameras, microphones, motion sensors, optical sensors, switches, touch displays, and keyboards. Memory 178 is a computer-readable medium that includes any kind of computer memory such as floppy disks, conventional hard disks, CD-ROMS, Flash ROMS, non-volatile ROM, RAM, and non-volatile memory. Processor 180 reads instructions 179 from memory 178 over data bus 182. Supply voltage VDD 181 is connected to microcontroller 171. On/Off button 182 generates and sends a signal to microcontroller 171 to power on toilet paper dispenser 100 if toilet paper dispenser is powered off, or to power off toilet paper dispenser 100 if toilet paper dispenser 100 is powered on. Microcontroller 171 receives power via supply voltage 181.

Signals sent from the input components to hardware interface 177 are designated in the figure. First motion sensor 159 sends a signal MS1 to hardware interface 177. Second motion sensor 176 sends a signal MS2 to hardware interface 177. Paper position sensor 160 sends a signal PPS to hardware interface 177. Paper length switch 153 sends a signal Paper Length to hardware interface 177. Microphone 174 sends a signal MIC to hardware interface 177. Three position switch 163 sends a signal TPS to hardware interface 177. Paper advance button 152 sends a signal PAB to hardware interface 177. Signals sent from hardware interface 177 to output components are also designated in the figure. Hardware interface 177 sends a signal MCTL to motor 173. Hardware interface 177 sends a signal L1CTL to motor LED strip light 156. Hardware interface 177 sends a signal L2CTL to light 164.

Microcontroller 171 receives power from supply voltage 181. Hardware interface 177 receives signals from the input components. Hardware interface 177 communicates with processor 180. Processor 180 interprets the signals received by hardware interface 177 from the input components. Processor 180 reads instructions 179 from memory 178 over data bus 182. Processor 180 applies the computer readable instructions 179 to produce output signal instructions. Processor 180 controls hardware interface 177 via data bus 182, to send the appropriate output signals to output components motor 173, LED strip light 156, or light 164.

Figure 11:
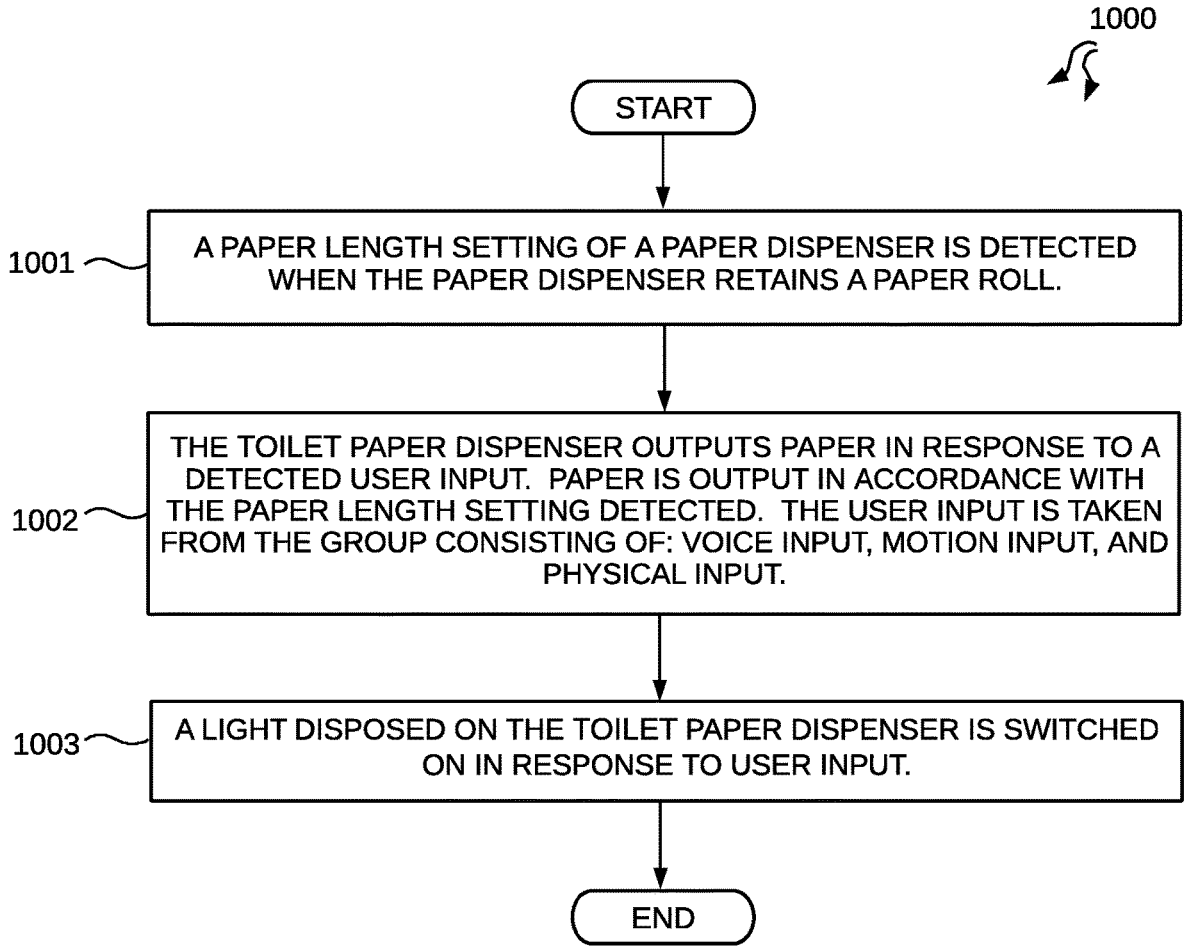
FIG. 11 is a flowchart of a method 1000 in accordance with one novel aspect.

FIG. 11 is a flowchart of a method 1000 in accordance with one novel aspect. In a first step (step 1001), a paper length setting of a paper dispenser is detected when the paper dispenser retains a paper roll. For example, in FIG. 9 a toilet paper dispenser 100 retains a paper roll 157. A paper length setting 166 is user selectable via a paper length switch 153. In this example, the paper length setting provides for two user selectable lengths.

In a second step (step 1002), the toilet paper dispenser outputs paper in response to a detected user input. Paper is output in accordance with the paper length setting detected. The user input is taken from the group consisting of: voice input, motion input, and physical input. For example, in FIG. 1, the toilet paper dispenser 100 outputs paper in response to detecting user input. The user input includes motion input detected via sensor 159, audio input detected via microphone 174, or physical input detected by paper advance button 152.

In a third step (step 1003), a light disposed on the toilet paper dispenser is switched on in response to user input. In the example of FIG. 8, light 164 is disposed on toilet paper dispenser 100. The light 164 is switched on in response to user input. The user input is motion and is detected by the second motion sensor 176.

Figure 12:
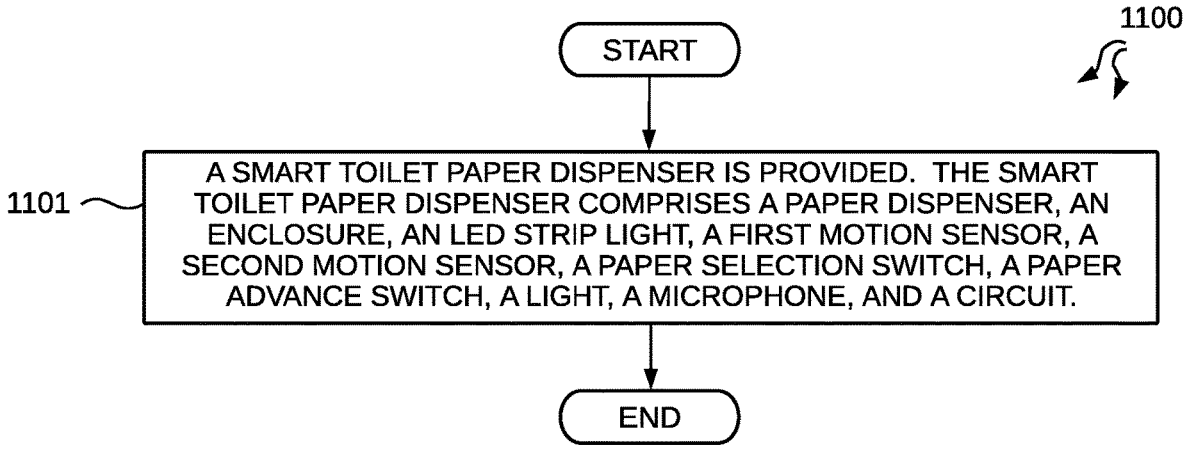
FIG. 12 is a flowchart of a method 1100 in accordance with another novel aspect.

FIG. 12 is a flowchart of a method 1100 in accordance with one novel aspect. In a first step (step 1101), a smart toilet paper dispenser is provided. The smart toilet paper dispenser comprises a paper dispenser, an enclosure, an led strip light, a first motion sensor, a second motion sensor, a paper length switch, a paper advance switch, a light, a microphone, and a circuit. For example, FIG. 1 is a diagram of a smart toilet paper dispenser 100 comprising a paper dispenser 150, an enclosure 101, an LED strip light 156, a first motion sensor 159, a second motion sensor 176, a paper length switch 153, a paper advance button 152, a light 164, a microphone 174, and a paper dispenser circuit 170.

Figure 13:
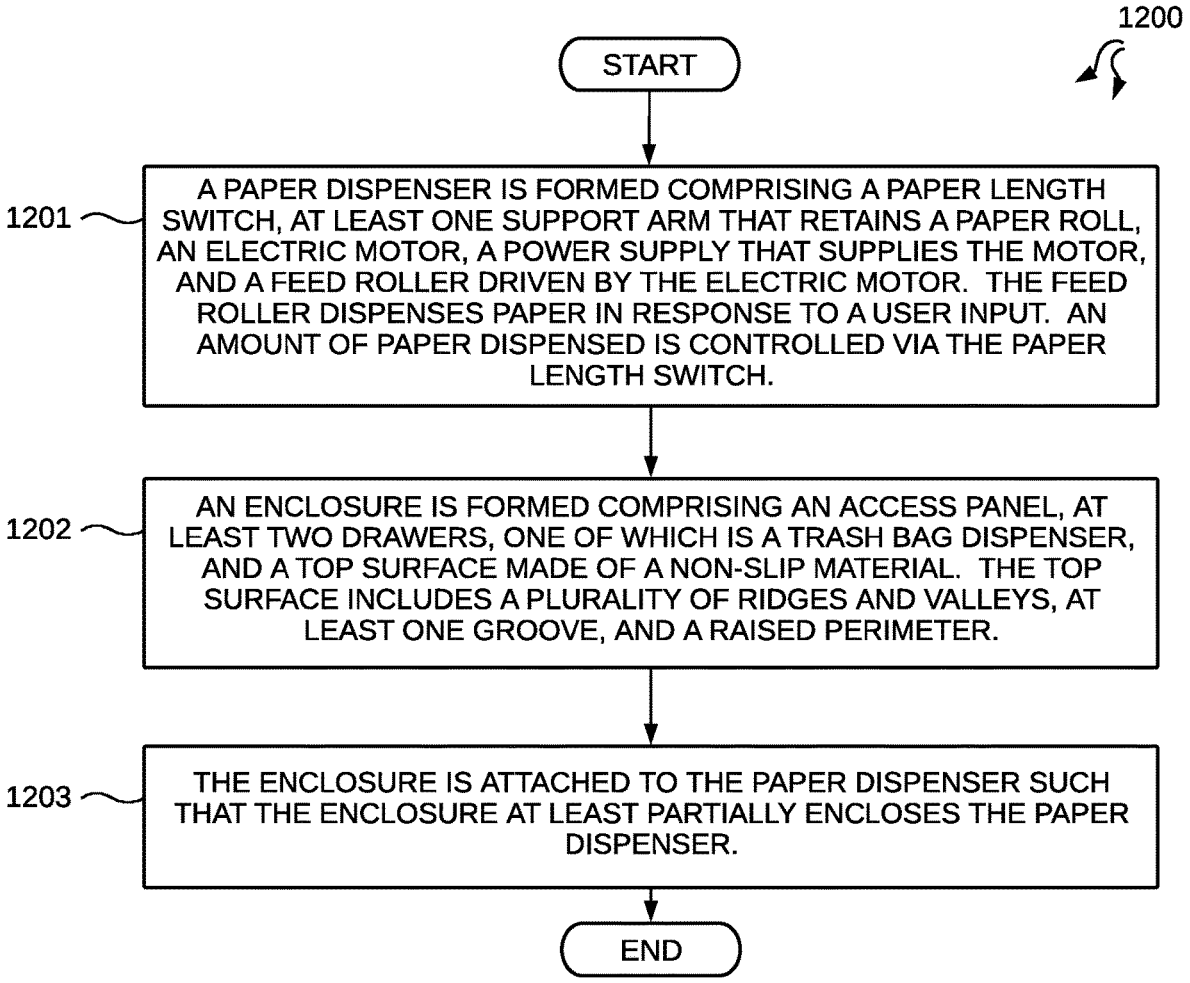
FIG. 13 is a flowchart of a method 1200 in accordance with another novel aspect.

FIG. 13 is a flowchart of a method 1200 in accordance with one novel aspect. In a first step (step 1201), a paper dispenser is formed comprising a paper length switch, at least one support arm that retains a paper roll, an electric motor, a power supply that supplies the motor, and a feed roller driven by the electric motor. The feed roller dispenses paper in response to a user input. An amount of paper dispensed is controlled via the paper length switch. For example, in FIG. 4, a paper dispenser 150 is provided comprising a paper length switch 152, at least one support arm 161 that retains a paper roll 157, an electric motor 173, a power supply 172 that supplies the motor 173, and a feed roller 158 driven by the electric motor 173. The feed roller 158 dispenses paper in response to a user input. An amount of paper dispensed is controlled via the paper length switch 152.

In a second step (step 1202), an enclosure is formed comprising an access panel, at least two drawers, one of which is a trash bag dispenser, and a top surface made of a non-slip material. The top surface includes a plurality of ridges and valleys, at least one groove, and a raised perimeter. For example, in FIG. 5, an enclosure 101 comprises a first drawer 102, a second drawer 103, and a top surface 104. Top surface 104 is made of a non-slip material and includes a plurality of ridges, a raised perimeter 108, and a groove 109. Reference numeral 107 indicates one of the ridges. In FIG. 7, the second drawer 103 holds trash bag roll 112 and is configured as a dispenser.

In a third step (step 1203), the enclosure is attached to the paper dispenser such that the enclosure at least partially encloses the paper dispenser. For example, in FIG. 1, enclosure 101 is attached to paper dispenser 150, via base 151, partially enclosing the paper dispenser 150.

Figure 14:
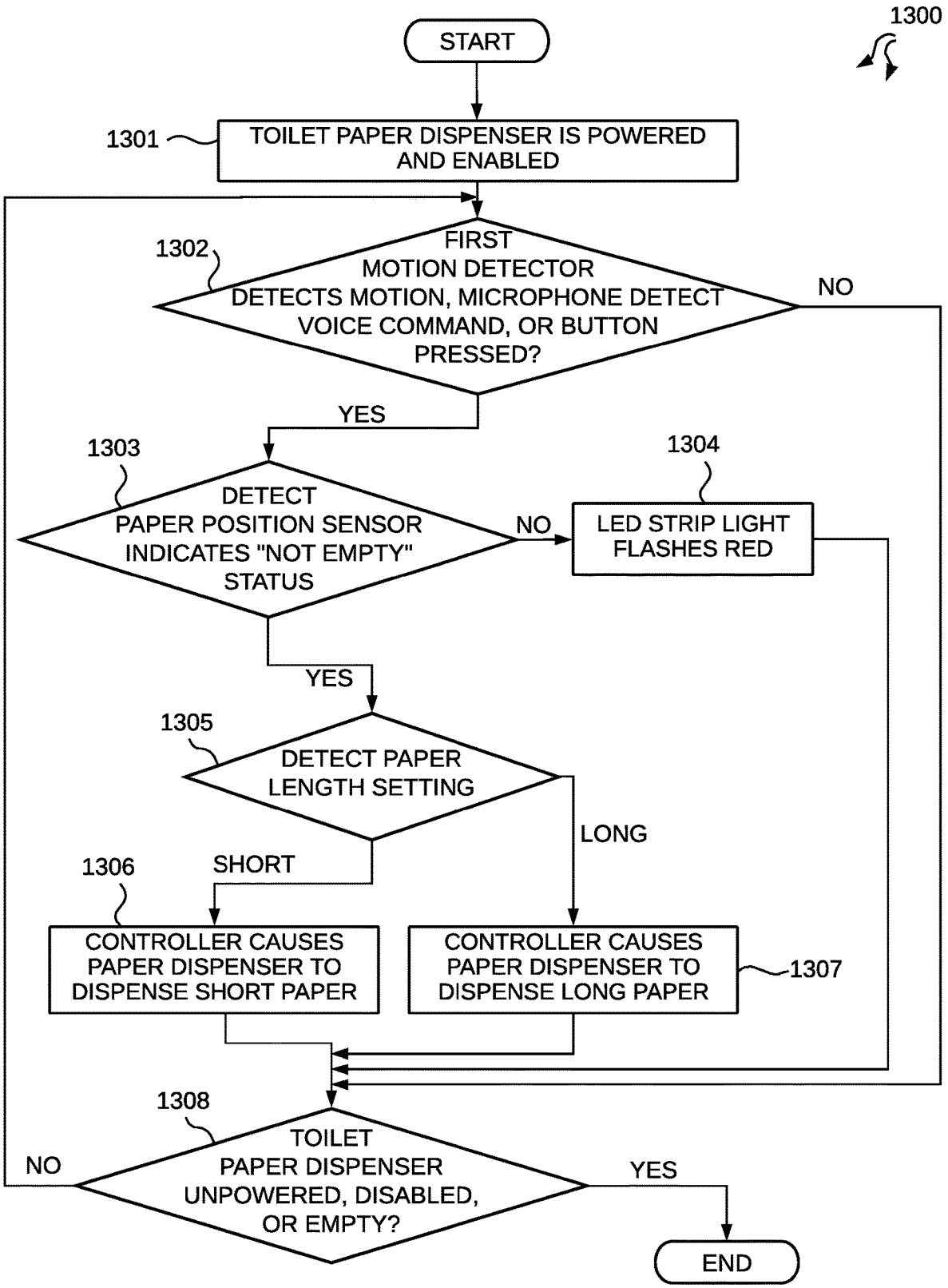
FIG. 14 is a flowchart of a method 1300 in accordance with another novel aspect.

FIG. 14 is a flowchart of a method 1300 in accordance with one novel aspect. In a first step (step 1301), a toilet paper dispenser is powered. For example, in FIG. 9 a paper dispenser circuit 170 includes a power supply 172.

In a second step (step 1302), a determination is made whether a first motion detector detects motion, a microphone detects a voice command, or a button is pressed. If a determination is made that a first motion detector detects motion, a microphone detects a voice command, or a button is pressed, the method proceeds to step 1303. If a determination is made that a first motion detector does not detect motion, a microphone does not detect a voice command, and a button is not pressed, then the method proceeds to step 1308. For example, in FIG. 9 a paper dispenser circuit 170 includes a motion sensor 159, a microphone 174, and a paper advance button 152.

In a third step, (step 1303), a determination is made whether a paper position sensor indicates a "not empty" status. If a determination is made that a paper position sensor does indicate a "not empty" status, then the method proceeds to step 1305. If a determination is made that a paper position sensor does not indicate a "not empty" status, then the method proceeds to step 1304. For example, in FIG. 9 a paper dispenser circuit 170 includes a paper position sensor 160. FIG. 4 also shows paper position sensor 160.

In a fourth step, an LED strip light is controlled by a microcontroller to flash red. For example, in FIG. 9 an LED strip light 156 receives a control signal L1CTL from microcontroller 171, in some instances this signal causes LED strip light 156 to flash red.

In a fifth step (step 1305), determination is made whether a paper length setting detected is short or long. If a determination is made that a short paper length setting is detected, the method proceeds to step 1306. If a determination is made that a long paper setting is detected, then the method proceeds to step 1307. For example, in FIG. 1, paper length switch 153 mounted to base 151 of paper dispenser 150.

In a sixth step (step 1306), a controller causes a paper dispenser to dispense a short length of paper.

In a seventh step (step 1307), a controller causes a paper dispenser to dispense a long length of paper.

In an eighth step (step 1308), a determination is made whether a toilet paper dispenser is unpowered, disabled, or empty. If a determination is made that the toilet paper dispenser is unpowered, disabled, or empty, then the method ends. If a determination is made that the toilet paper dispenser is not unpowered, not disabled, and not empty, then the method proceeds to step 1302. For example, in FIG. 9 a paper dispenser circuit 170 is powered by power supply 172. In one embodiment, power supply 172 is a battery. Paper dispenser circuit 170 includes a paper position sensor 160 capable of sending an "empty" signal to microcontroller 171.

Figure 15:
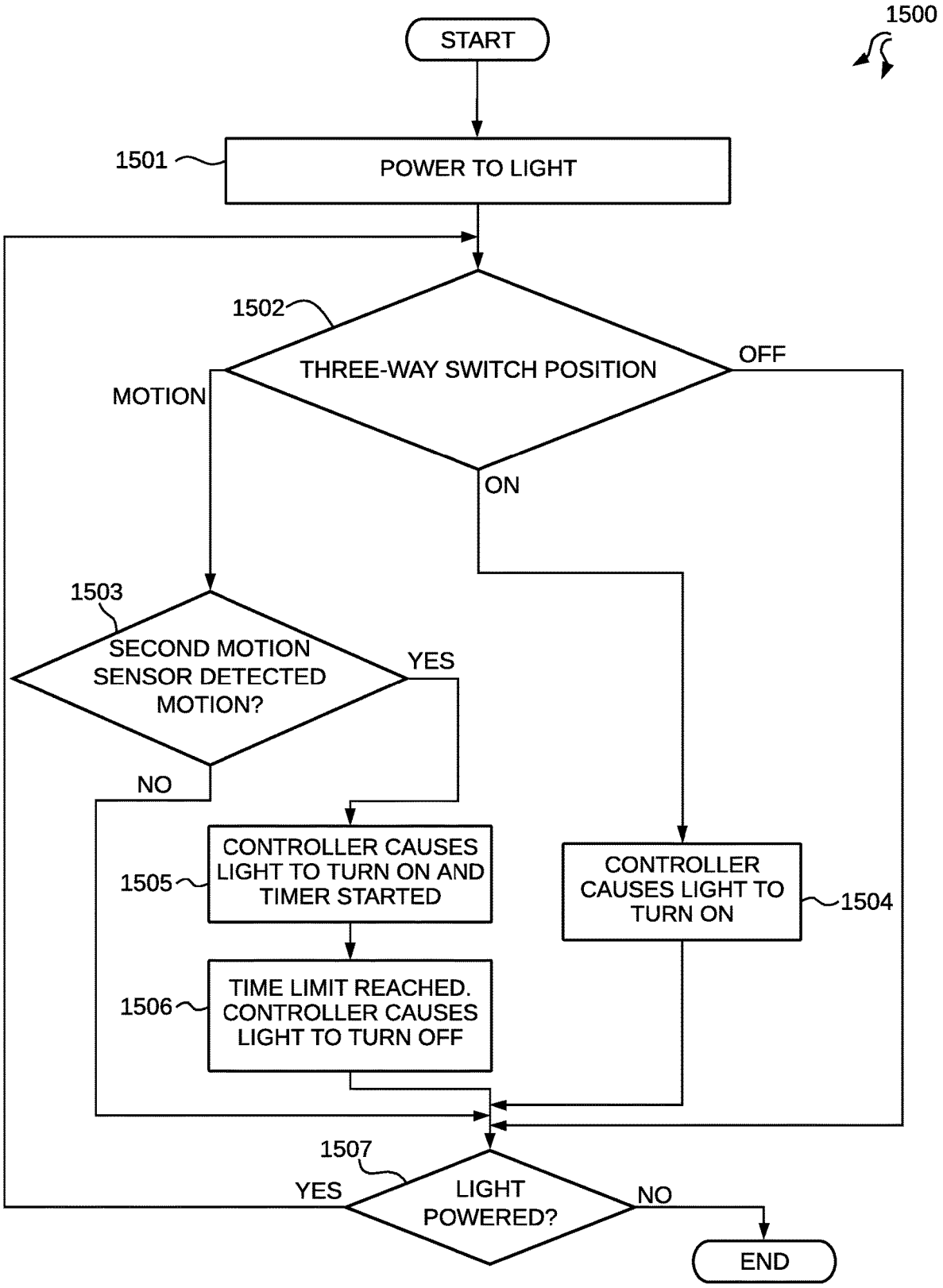
FIG. 15 is a flowchart of a method 1500 in accordance with another novel aspect.

FIG. 15 is a flowchart of a method 1500 in accordance with one novel aspect. In a first step (step 1501), power is provided to a light. For example, FIG. 9 shows a light 164 connected to a power supply 172. In a second step (step 1502), a determination is made whether a three-way switch is in the "off" position, the "On" position, or the "Motion" position. If a determination is made that the switch is in the "off" position, the method proceeds to step 1507. If a determination is made that the switch is in the "on" position, the method proceeds to step 1504. If a determination is made that the switch is in the "motion" position, the method proceeds to step 1503. For example, in FIG. 9, a three-position switch 153 is connected to a microcontroller 171. In a third step (1503), a determination is made whether a second motion detector detects motion or does not detect motion. If a determination is made that the second motion sensor detects motion, the method proceeds to step 1505. If a determination is made that the second motion sensor does not detect motion, the method proceeds to step 1507. For example, in FIG. 9 second motion sensor 176 is connected to microcontroller 171. In a fourth step (step 1504), a controller controls a light to turn on. For example, in FIG. 9 light 164 is connected to microcontroller 171 and light 164 receives a control signal L2CTL from microcontroller 171. In a fifth step (step 1505), a controller controls a light to turn on and a timer is started. For example, in FIG. 9 light 164 is connected to microcontroller 171 and light 164 receives a control signal L2CTL from microcontroller 171. In a sixth step (step 1506), a time limit measured by the timer is reached, and the controller causes the light to turn off. For example, in FIG. 9 light 164 is connected to microcontroller 171 and light 164 receives a control signal L2CTL from microcontroller 171. In a seventh step (step 1507), a determination is made whether the light is powered. If it is determined that the light is not powered, the method ends. If it is determined that the light is powered, the method proceeds to step 1502.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. An apparatus comprising:

a paper dispenser, wherein when a paper roll is loaded within the paper dispenser, the paper dispenser dispenses paper from the paper roll in response to user input; and an enclosure that partially covers the paper dispenser, wherein the enclosure includes at least two drawers, a top surface, and an access panel configurable into an open position and a closed position wherein one of the drawers includes a trash bag dispenser, wherein the top surface includes a non-slip material, wherein the top surface includes at least one groove, and wherein the top surface includes a raised perimeter.

2. The apparatus of claim 1, wherein when the access panel is in the open position, the paper dispenser within the enclosure is accessible and allows the paper roll to be changed, and wherein when the access panel is in the closed position, access to an inside of the enclosure is blocked.

3. The apparatus of claim 1, further comprising:

a paper length switch;

at least one support arm that retains the paper roll;

an electric motor;

a power supply, wherein the power supply supplies the motor; and a feed roller, wherein the electric motor drives the feed roller to dispense paper in response to the user input, and wherein an amount of paper dispensed is controlled via the paper length switch.

4. The apparatus of claim 3, further comprising:

a paper position sensor, the paper position sensor is used to determine how much paper remains on the paper roll.

5. The apparatus of claim 1, further comprising:

a motion sensor;

a push button; and a microphone, wherein the user input is generated via at least one of the motion sensor, the push button, and the microphone.

6. The apparatus of claim 1, further comprising:

a light source; and a light switch, wherein the light switch controls a setting of the light source.

7. The apparatus of claim 1, wherein the paper dispenser includes a cutting edge.

8. The apparatus of claim 1, wherein the user input causes the paper dispenser to dispense paper when paper is loaded in the paper dispenser, and wherein the user input is selected from the group consisting of: detecting a button is pushed, detecting motion via a motion sensor, and receiving a voice command via a microphone.

9. A method comprising:

detecting a paper length setting of a paper dispenser, wherein the paper dispenser retains a paper roll; and causing the paper dispenser to output paper in response to detecting user input, wherein paper is output in accordance with the paper length setting detected, wherein the user input is taken from the group consisting of: voice input, motion input, and physical input, wherein the paper dispenser is disposed within an enclosure, and wherein the enclosure comprises:

an access panel;

at least two drawers, wherein one of the drawers is a trash bag dispenser; and a top surface having non-slip material, wherein the top surface has a plurality of ridges or valleys, wherein the top surface includes at least one groove, and wherein the top surface includes a raised perimeter.

10. The method of claim 9, further comprising:

switching on a light disposed below the paper dispenser, wherein the light is switched on in response to user input.

11. The method of claim 10, wherein the light is turned off in response to a time limit being reached.

12. The method of claim 9, further comprising:

switching on a light disposed below the paper dispenser, wherein the light is controlled via a switch.

13. The method of claim 9, wherein the paper dispenser comprises:

a paper length switch;

at least one support arm that retains the paper roll;

an electric motor;

a power supply, wherein the power supply supplies the motor; and a feed roller, wherein the electric motor drives the feed roller to dispense paper in response to the user input, and wherein an amount of paper dispensed is controlled via the paper length switch.

14. The method of claim 9, wherein the paper dispenser further comprises:

a motion sensor;

a push button; and a microphone, wherein the user input is generated via at least one of the motion sensor, the push button, or the microphone.

15. An apparatus comprising:

an enclosure that stores paper, wherein the enclosure includes at least two drawers, a top surface, and an access panel, wherein one of the drawers includes a trash bag dispenser, wherein the top surface includes a non-slip material, wherein the top surface includes at least one groove, and wherein the top surface includes a raised perimeter; and means for dispensing the paper in response to voice input, motion input, and physical input.

16. The apparatus of claim 15, wherein the means is also for measuring how much paper is dispensed, wherein the means is a paper dispenser having a microphone, a motion sensor, an incremental encoder, and at least one button, and wherein the paper dispenser retains a paper roll.

17. The apparatus of claim 15, wherein the means is at least partially enclosed by the enclosure.

18. A method comprising:

forming a paper dispenser, wherein the paper dispenser comprises:

a paper length switch;

at least one support arm that retains a paper roll;

an electric motor;

a power supply, wherein the power supply supplies the motor; and a feed roller, wherein the electric motor drives the feed roller to dispense paper in response to the user input, and wherein an amount of paper dispensed is controlled via the paper length switch; and forming an enclosure, wherein the enclosure comprises:

an access panel;

at least two drawers, wherein one of the drawers is a trash bag dispenser; and a top surface made of a non-slip material, wherein the top surface is a plurality of ridges or valleys, wherein the top surface includes at least one groove, and wherein the top surface includes a raised perimeter.

19. The method of claim 18, further comprising:

attaching the paper dispenser to the enclosure such that the enclosure at least partially encloses the paper dispenser.

* * * * *